US008608023B2

(12) United States Patent
Case et al.

(10) Patent No.: US 8,608,023 B2
(45) Date of Patent: Dec. 17, 2013

(54) SHEET PRODUCT DISPENSER

(75) Inventors: Abby C. Case, Green Bay, WI (US); Matthew K. F. Williquette, Sobieski, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 594 days.

(21) Appl. No.: 12/766,285

(22) Filed: Apr. 23, 2010

(65) Prior Publication Data

US 2011/0259908 A1 Oct. 27, 2011

(51) Int. Cl.
*B65H 1/00* (2006.01)
*B65H 1/08* (2006.01)
*A47K 10/24* (2006.01)

(52) U.S. Cl.
USPC ..... 221/63; 221/59; 221/56; 221/279; 221/280; 221/45; 221/52; 221/55; 221/33; 221/47; 221/53; 221/44

(58) Field of Classification Search
CPC ..... B65H 1/00; B65H 1/08; A47K 10/24
USPC ..... 221/59, 56, 44, 45, 33, 279, 280, 52, 221/55, 63, 47, 53
See application file for complete search history.

(56) References Cited

U.S. PATENT DOCUMENTS 1,577,094 A * 3/1926 Arms ..... 221/48
1,993,885 A * 3/1935 Horwitt ..... 221/55
3,747,802 A * 7/1973 Uroshevich ..... 221/63
4,623,074 A * 11/1986 Dearwester ..... 221/48
4,706,844 A * 11/1987 Omdoll et al. ..... 221/59
5,076,466 A * 12/1991 Petterson et al. ..... 221/46
5,102,007 A * 4/1992 Petterson et al. ..... 221/6
5,137,173 A * 8/1992 Hughes et al. ..... 221/34
5,884,804 A * 3/1999 King ..... 221/45
6,257,443 B1 * 7/2001 LaCount ..... 221/35
6,378,726 B1 * 4/2002 Chan et al. ..... 221/51
6,508,382 B2 * 1/2003 Niada ..... 221/45
6,779,683 B2 * 8/2004 Taylor et al. ..... 221/61
6,824,007 B2 * 11/2004 Timmers et al. ..... 221/53
6,981,610 B2 * 1/2006 Smiley et al. ..... 221/33
6,988,635 B2 * 1/2006 Hochtritt et al. ..... 221/44
7,124,911 B2 * 10/2006 Tramontina et al. ..... 221/45
7,134,571 B2 11/2006 Hochtritt et al.
7,178,689 B2 * 2/2007 Wieser et al. ..... 221/52
7,341,166 B2 * 3/2008 Reinsel et al. ..... 221/59
7,543,719 B2 * 6/2009 Young et al. ..... 221/52
7,568,893 B2 * 8/2009 Koyama ..... 417/32
7,648,045 B2 * 1/2010 Christensen et al. ..... 221/53
7,721,913 B2 * 5/2010 Nash et al. ..... 221/60
7,845,515 B2 * 12/2010 Moody ..... 221/36
7,922,036 B2 * 4/2011 Bendor et al. ..... 221/63

(Continued)

*Primary Examiner* — Gene O. Crawford
*Assistant Examiner* — Rakesh Kumar
(74) *Attorney, Agent, or Firm* — William W. Letson

(57) ABSTRACT

A sheet product dispenser includes a body portion defining an inner cavity arranged to support a stack of sheet products and a faceplate attached to the body portion. The faceplate portion is arranged to support and dispense the sheet products, has an opening comprising a rectangular portion with a centrally disposed arcing triangular portion having a centrally disposed arced apex, the rectangular portion extends from an upper edge of the faceplate to the arced apex, the opening is arranged to expose a plurality of the sheet products on one end of the body portion through the rectangular portion and to expose a planar surface of a single sheet product through the arcing triangular portion.

19 Claims, 14 Drawing Sheets

(56) References Cited

U.S. PATENT DOCUMENTS

| | | | | |
|---|---|---|---|---|
| 8,152,021 | B2 * | 4/2012 | Babikian | 221/45 |
| 2002/0139705 | A1 * | 10/2002 | Hajianpour | 206/494 |
| 2003/0062375 | A1 * | 4/2003 | Christensen et al. | 221/46 |
| 2003/0127352 | A1 * | 7/2003 | Buschkiel et al. | 206/494 |
| 2003/0192903 | A1 * | 10/2003 | Sauer et al. | 221/48 |
| 2004/0206768 | A1 * | 10/2004 | Tramontina et al. | 221/46 |
| 2005/0206693 | A1 * | 9/2005 | Chen | 347/85 |
| 2006/0180596 | A1 * | 8/2006 | Young et al. | 221/63 |
| 2007/0215632 | A1 * | 9/2007 | Bendor et al. | 221/63 |

* cited by examiner

SHEET PRODUCT DISPENSER

BACKGROUND OF THE INVENTION

The present invention relates generally to sheet product dispensers, and more particularly to sheet product dispensers adapted for dispensing a selectable number of folded sheet products.

Sheet product dispensers are devices that store and dispense sheet products. The dispensers may be mounted to a surface such as a wall, or may be placed on a horizontal surface such as a counter top. A number of sheet products such as napkins or other folded sheet products may be stacked and stored in the dispenser. Individual sheet products may be removed from the dispenser by a user by, for example, pulling a sheet product through an opening in a faceplate of the sheet product dispenser. Accordingly, sheet products are dispensed via the faceplate in response to a user grasping sheet products through the opening.

While existing sheet product dispensing products are suitable for their intended purpose, application of multiple grasping motions in order to acquire a plurality of sheet products may result in jamming the dispenser, thereby requiring dispenser service. Additionally, excessive force, or rate of force application, may result in unintentional removal of the faceplate, associated dispersal and fouling of the sheet products, and additional dispenser service. Accordingly, there is a need in the art for a sheet product dispenser arrangement that overcomes these drawbacks.

BRIEF DESCRIPTION OF THE INVENTION

According to example embodiments, a sheet product dispenser includes a body portion defining an inner cavity arranged to support a stack of sheet products and a faceplate attached to the body portion. The faceplate portion is arranged to support and dispense the sheet products, has an opening comprising a rectangular portion with a centrally disposed arcing triangular portion having a centrally disposed arced apex, the rectangular portion extends from an upper edge of the faceplate to the arced apex, the opening is arranged to expose a plurality of the sheet products on one end of the body portion through the rectangular portion and to expose a planar surface of a single sheet product through the arcing triangular portion.

According to additional example embodiments, a sheet product dispenser includes a first side wall, a rear wall joined to the first side wall, a second side wall joined to the rear wall, a front wall joined to the second side wall, and a faceplate attached to the body portion. The faceplate is arranged to support and dispense the sheet products, the faceplate has an opening comprising a rectangular portion with a centrally disposed arcing triangular portion having a centrally disposed arced apex, the rectangular portion extends beyond an upper edge of the faceplate to the arced apex, the opening is arranged to expose a plurality of the sheet products on one end of the body portion through the rectangular portion and to expose a planar surface of a single sheet product through the arcing triangular portion.

According to additional example embodiments, a faceplate of a sheet product dispenser includes an opening. The opening is arranged to expose a plurality of the sheet products on one end of the body portion through a rectangular portion of the opening and to expose a planar surface of a single sheet product through a triangular portion of the opening. The rectangular portion of the opening protrudes from the faceplate. The triangular portion of the opening extends from the bottom edge of the protruding rectangular portion of the faceplate to an apex point beyond a height of the protruding rectangular portion.

These and other features of the present invention will be better appreciated by reference to the appended drawings and the description which follows.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Example embodiments of the present invention are directed to sheet-product dispensers, and more particularly, to napkin dispensers.

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from a roll or folded arrangement at discrete intervals. Individual sheets may be sized as desired to accommodate the many uses of the sheet products. For example, perforation lines may be formed every 13 inches, or other defined interval, to define a universally sized sheet. Multiple perforation lines may be provided to allow the user to select the size of sheet depending on the particular need.

As used herein, "rectangular" refers to a substantially rectangular feature, which should be interpreted to include any feature being rectangular, substantially rectangular (e.g., having a longitudinal dimension greater than a transverse dimension of the feature), oblong, or substantially enabling a plurality of sheet products to be accessed simultaneously.

Hereinafter, example embodiments are described in detail with reference to the drawings.

Figure 1:
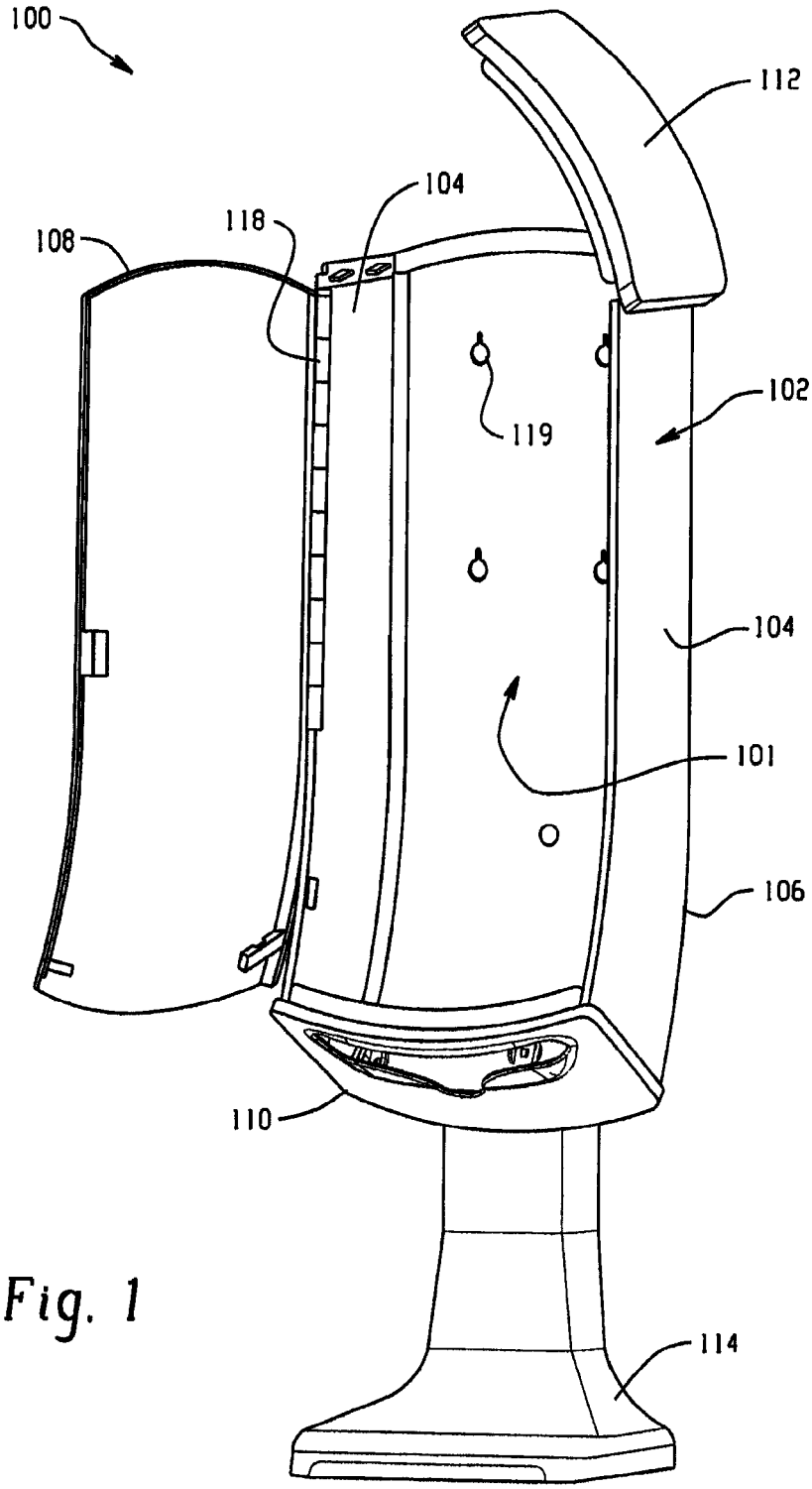
FIG. 1 illustrates a perspective view of an example embodiment of a sheet product dispenser.

Referring to FIG. 1, the sheet product dispenser (dispenser) 100 includes a body portion 102 that includes side walls 104, a rear wall 106, a front wall 108, and a bottom assembly 110 that define an inner cavity 101. In the illustrated embodiment, the front wall 108 is joined to a side wall 104 with a hinge 118, however alternate embodiments may include a front wall 108 that is joined to the side walls 104 with any suitable joint such as, for example an integral connection, a slidable joint, or a snap-fit joint. The dispenser 100 may include a top member 112 that is joined to a side wall 104 with any suitable joint such as, for example a hinge joint, a slidable joint, or a snap-fit joint. The dispenser 100 may include a pedestal member 114 that supports the body portion 102 on a surface (not shown). In the illustrated embodiment, the pedestal member 114 is removable, and the body portion 102 may be mounted to a surface such as, for example, a vertical wall through mounting holes 119.

Figure 2:
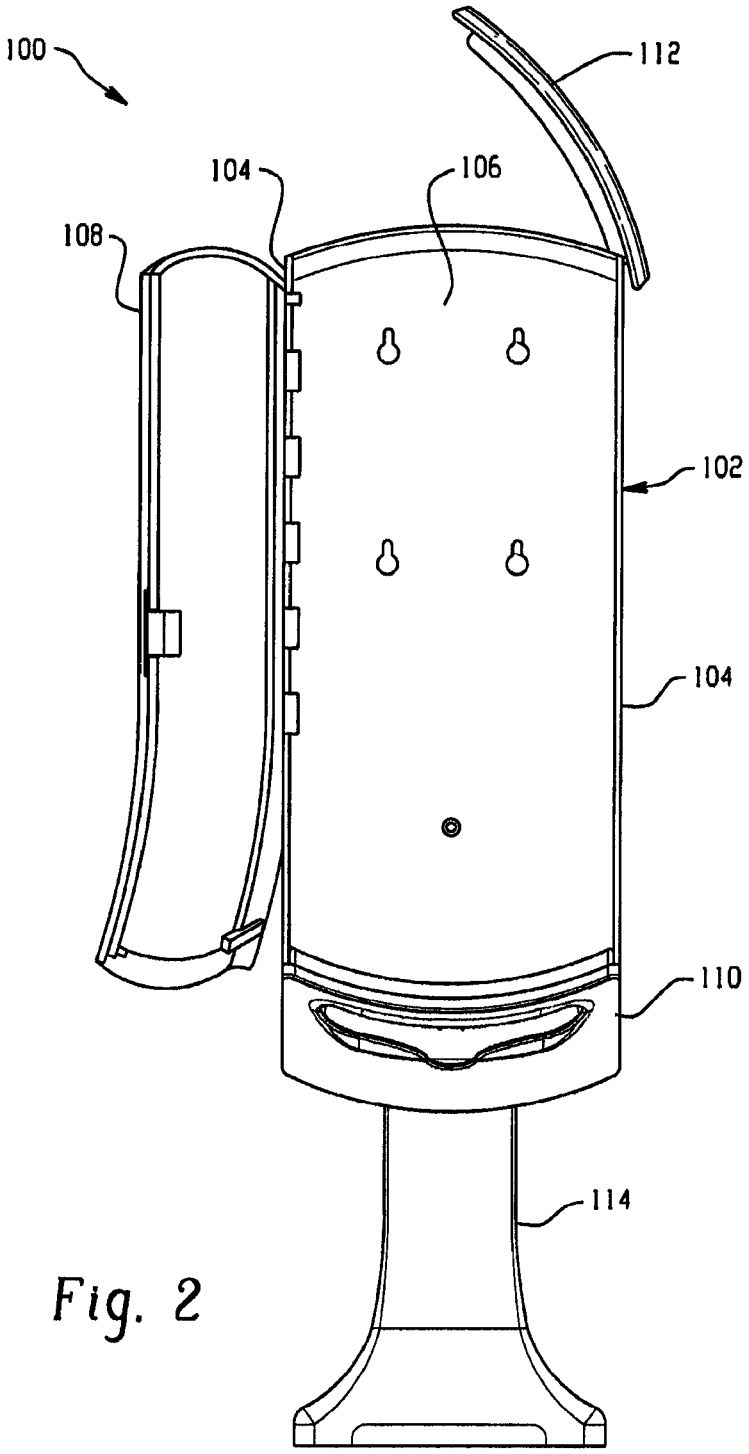
FIG. 2 illustrates a front view of the sheet product dispenser of FIG. 1.

FIG. 2 illustrates a front view of the sheet product dispenser 100.

Figure 3:
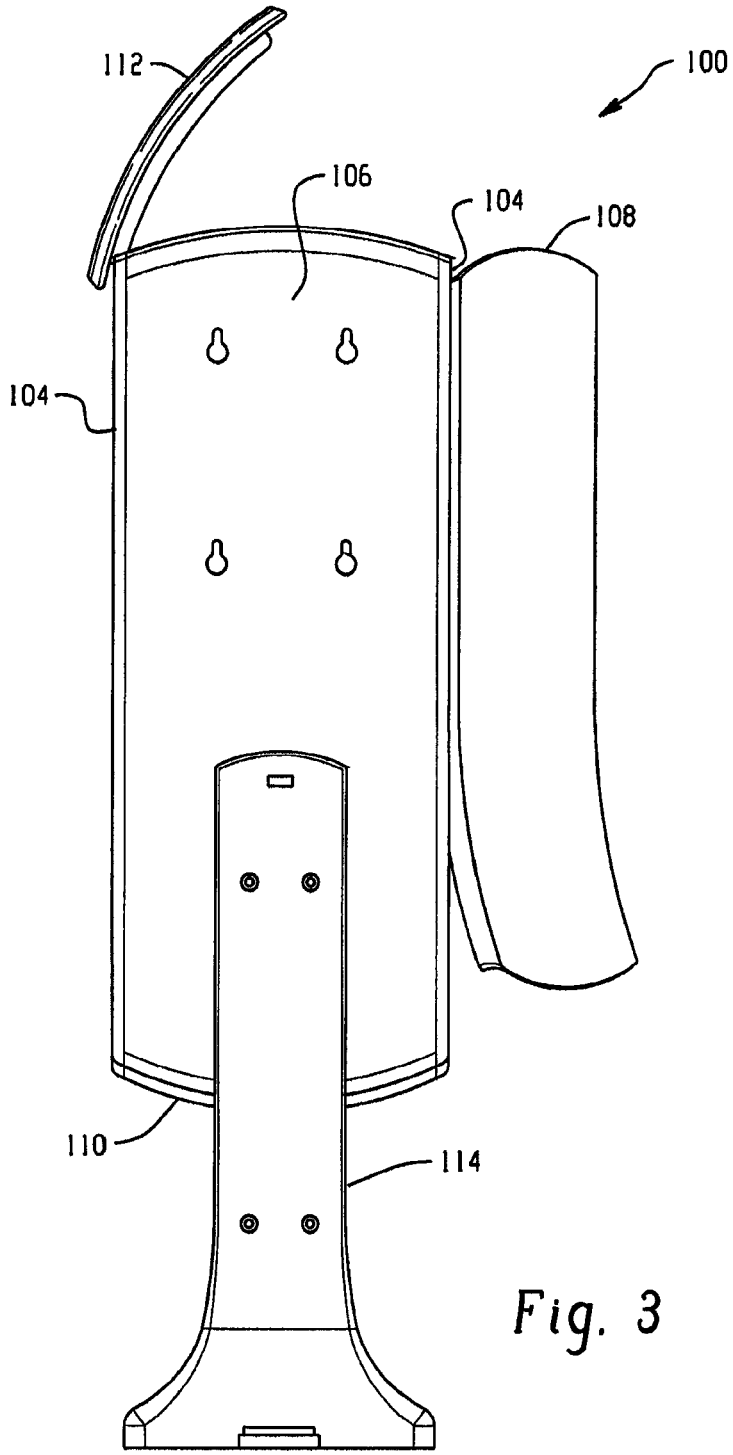
FIG. 3 illustrates a rear view of the sheet product dispenser of FIG. 1.

FIG. 3 illustrates a rear view of the sheet product dispenser 100.

Figure 4:
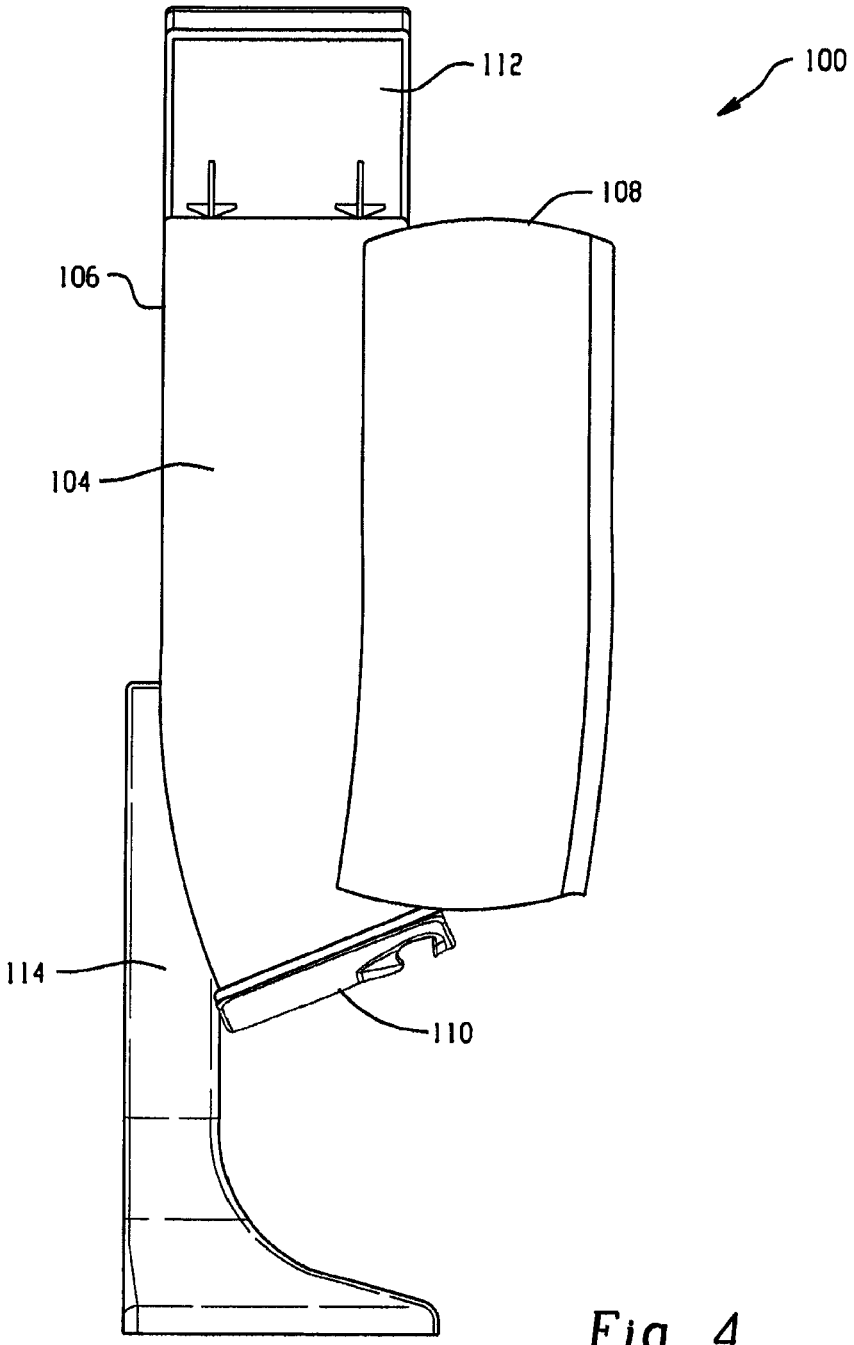
FIG. 4 illustrates a side view of the sheet product dispenser of FIG. 1.

FIG. 4 illustrates a side view of the sheet product dispenser 100.

Figure 5:
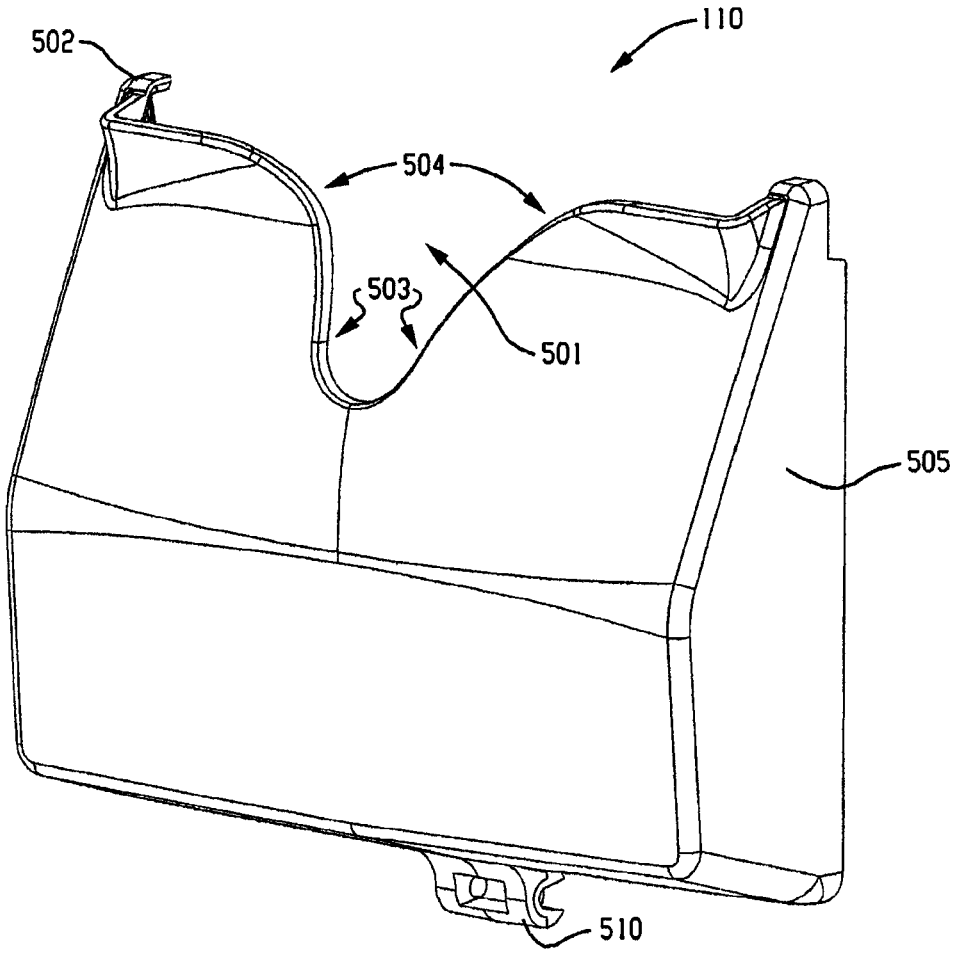
FIG. 5 illustrates a perspective view of a faceplate of a sheet product dispenser, according to an example embodiment.

FIG. 5 illustrates a perspective view of a faceplate of a sheet product dispenser 100, according to an example embodiment. As illustrated, the faceplate 110 includes an opening 501 defined by features 502, 503, and 504 of body portion 505. In an embodiment, feature 502 is a rectangular portion of the opening 501 extending from an upper edge of the body portion 505, defining an upper portion of the opening 501, which enables a plurality of sheet products to be accessed simultaneously. In an embodiment, feature 504 is an arcing portion extending from a lower edge of the feature 502 towards a lower and more confined arced apex of feature 503. The combination of features 503 and 504 form an arcing triangular portion which exposes a planar surface of a single sheet product. As illustrated, the combination of features 502, 503, and 504 allow dispensing of a selectable number of sheet products as the feature 502 allows access to a plurality of sheet products, and the arcing portions 504, and 503 allow selection of any number of the accessible plurality of sheet products in a sequential fashion.

It is noted that due to the selectivity of the combination of features 502, 503, and 504, a user may access a plurality of sheet products through the use of a single hand, thereby simplifying sheet product dispensing.

In an embodiment, the faceplate 110 further includes an attachment portion 510. The attachment portion 510 may be a tab, hinge joint, a slidable joint, a snap-fit joint, or any other suitable attachment portion.

Figure 6:
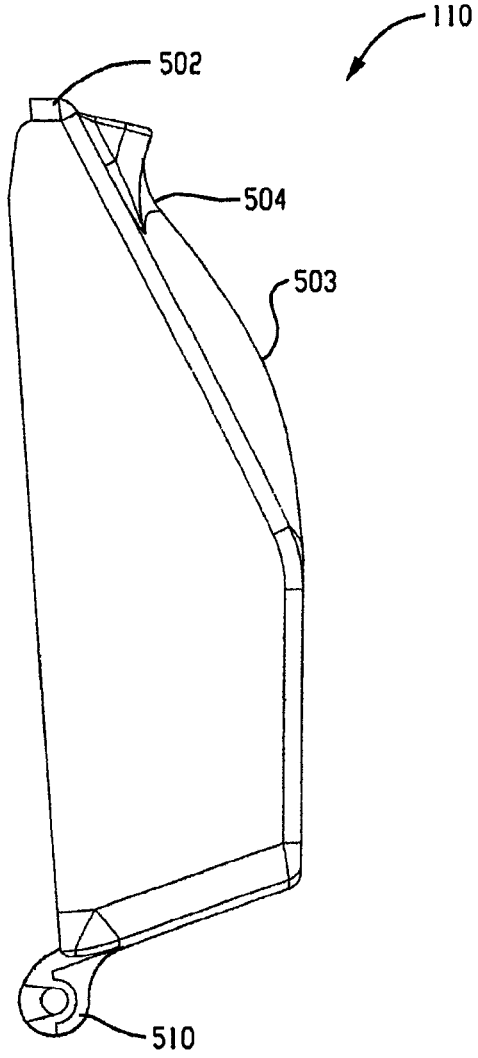
FIG. 6 illustrates a side view of the faceplate of FIG. 5.

FIG. 6 illustrates a side view of the faceplate 110.

Figure 7:
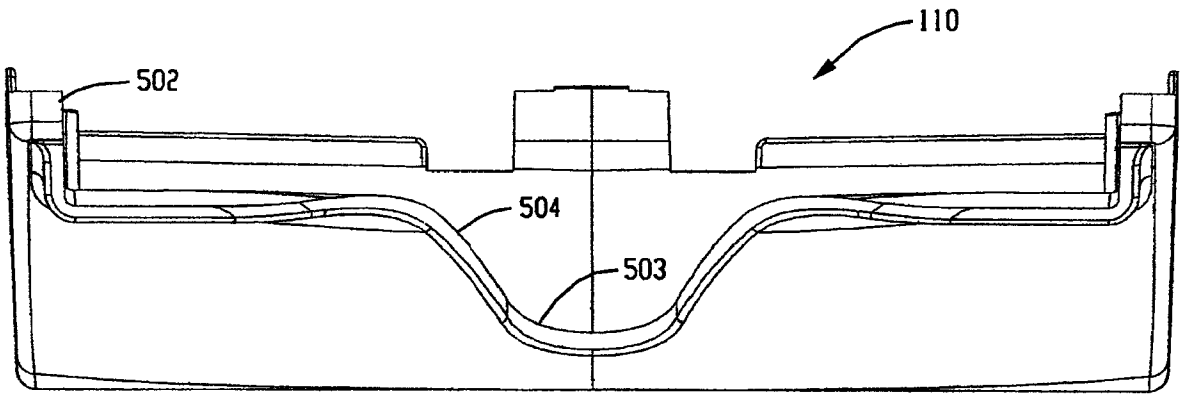
FIG. 7 illustrates a top view of the faceplate of FIG. 5.

FIG. 7 illustrates a top view of the faceplate 110.

Figure 8:
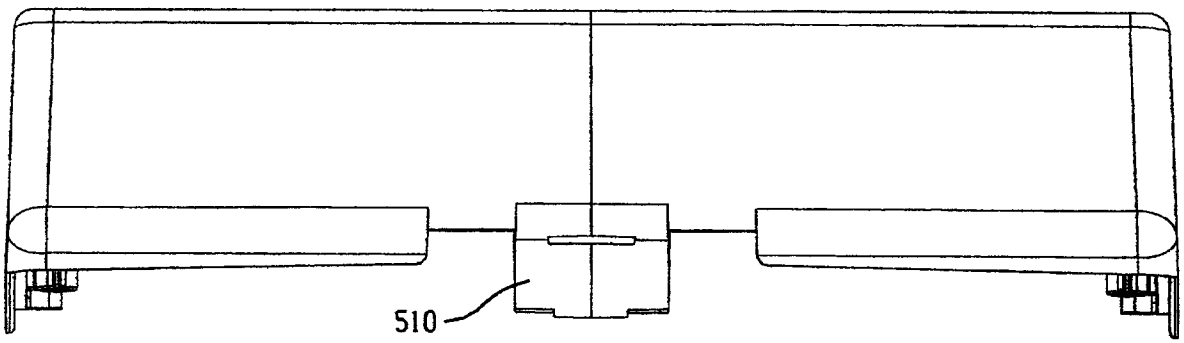
FIG. 8 illustrates a bottom view of the faceplate of FIG. 5.

FIG. 8 illustrates a bottom view of the faceplate 110.

Figure 9:
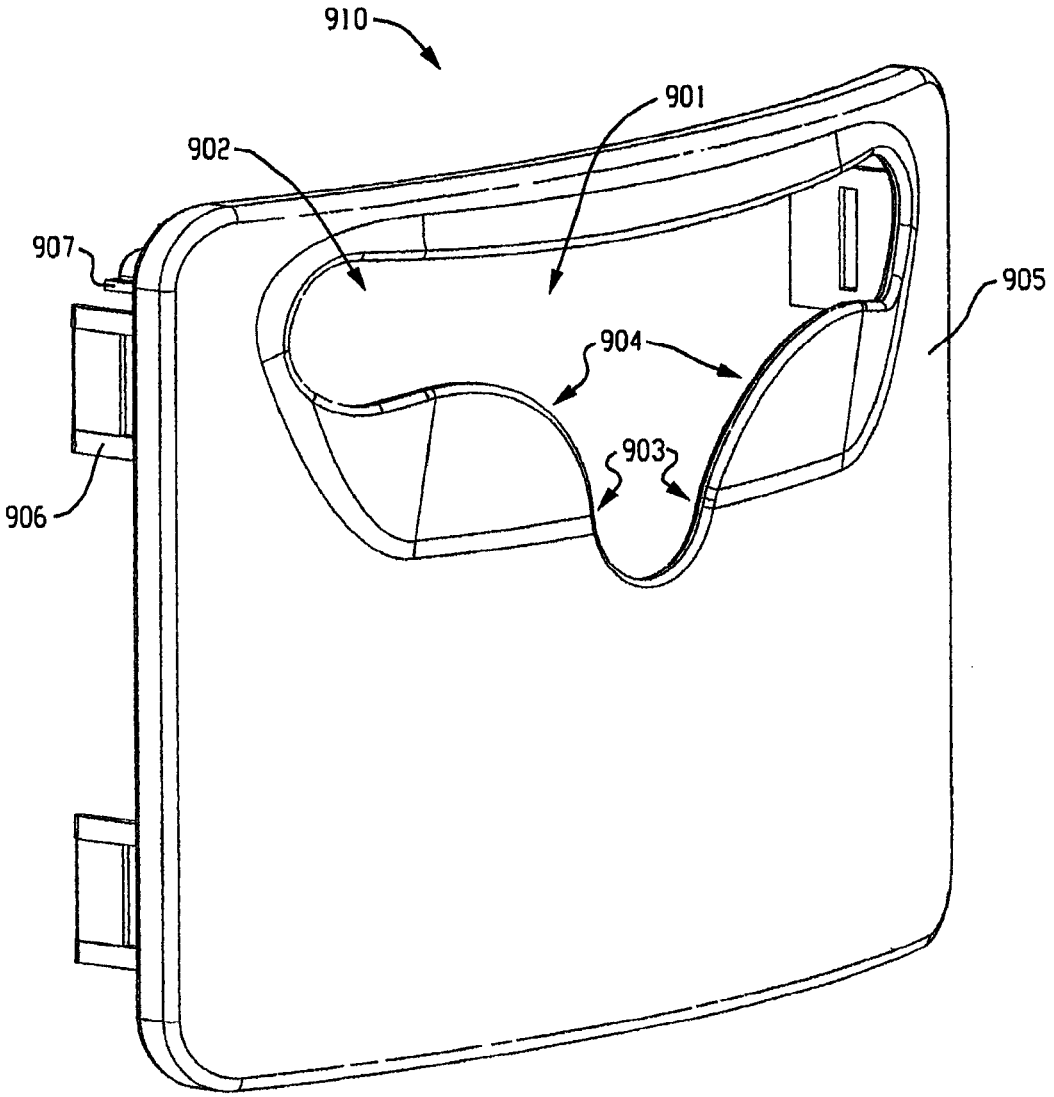
FIG. 9 illustrates a perspective view of another faceplate of a sheet product dispenser, according to an example embodiment.

FIG. 9 illustrates a perspective view of a faceplate of a sheet product dispenser, according to an example embodiment. As illustrated, the faceplate 910 includes an opening 901 defined by features 902, 903, and 904 of body portion 905. In an embodiment, feature 902 is a substantially rectangular portion of the opening 901 extending from an upper edge of the body portion 905, defining an upper portion of the opening 901, which enables a plurality of sheet products to be accessed simultaneously.

In an embodiment, feature 904 is an arcing portion extending from a lower edge of the feature 902 towards a lower and more confined arced apex of feature 903. The combination of features 903 and 904 form an arcing triangular portion which exposes a planar surface of a single sheet product. As illustrated, the combination of features 902, 903, and 904 allow dispensing of a selectable number of sheet products as the feature 902 allows access to a plurality of sheet products, and the arcing portions 904, and 903 allow selection of any number of the accessible plurality of sheet products in a sequential fashion.

It is noted that due to the selectivity of the combination of features 902, 903, and 904, a user may access a plurality of sheet products through the use of a single hand, thereby simplifying sheet product dispensing.

In an embodiment, the faceplate 910 further includes attachment portions 906-907. The attachment portions 906-907 may be tabs, joints, slidable joints, snap-fit joints, or any other suitable attachment portion.

It is noted that the combination of features 902, 903, and 904 may form a sheet product dispensing feature relatively smaller than the combination of features 502, 503, and 504 discussed above. Therefore, the arcing triangular portion illustrated in FIG. 9 may be of relatively reduced height compared to the arcing triangular portion illustrated in FIG. 5.

Figure 10:
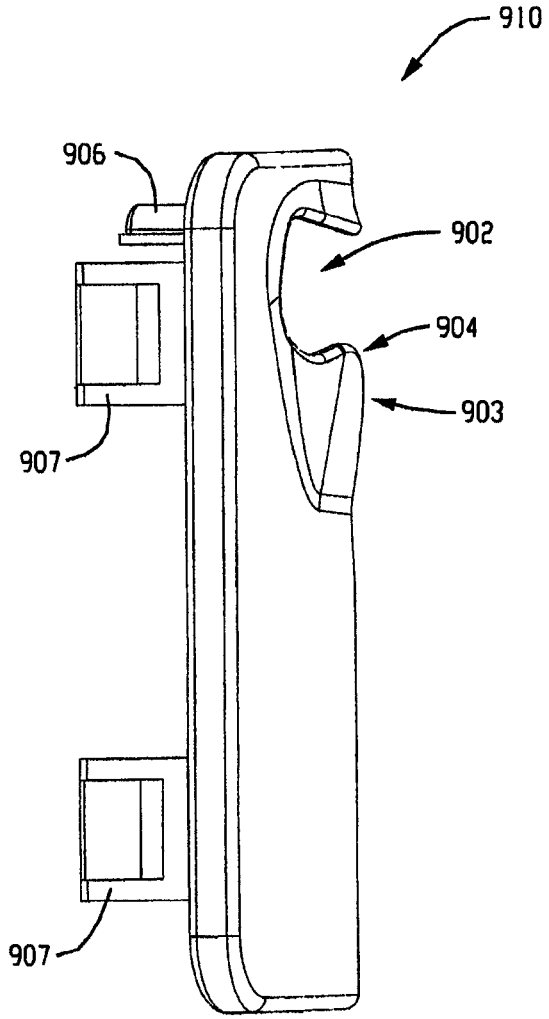
FIG. 10 illustrates a side view of the faceplate of FIG. 9.

FIG. 10 illustrates a side view of the faceplate 910.

Figure 11:
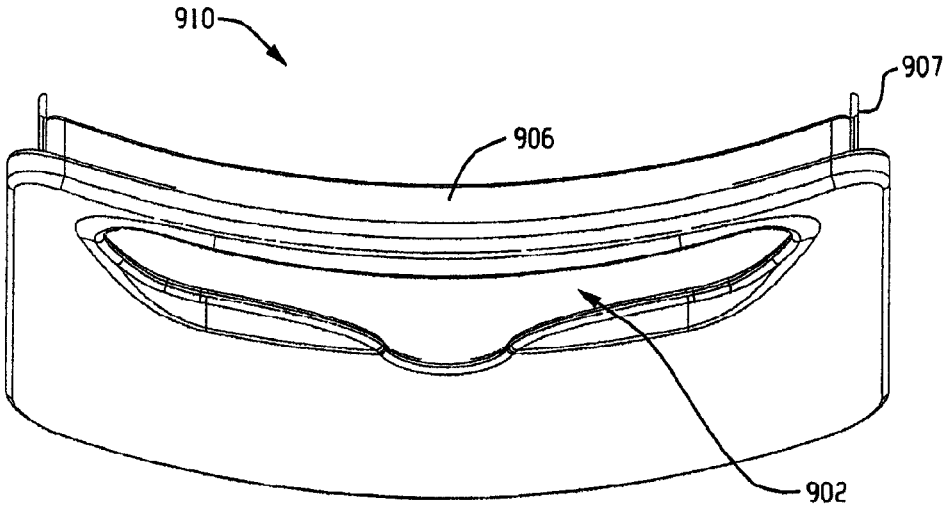
FIG. 11 illustrates a top view of the faceplate of FIG. 9.

FIG. 11 illustrates a top view of the faceplate 910.

Figure 12:
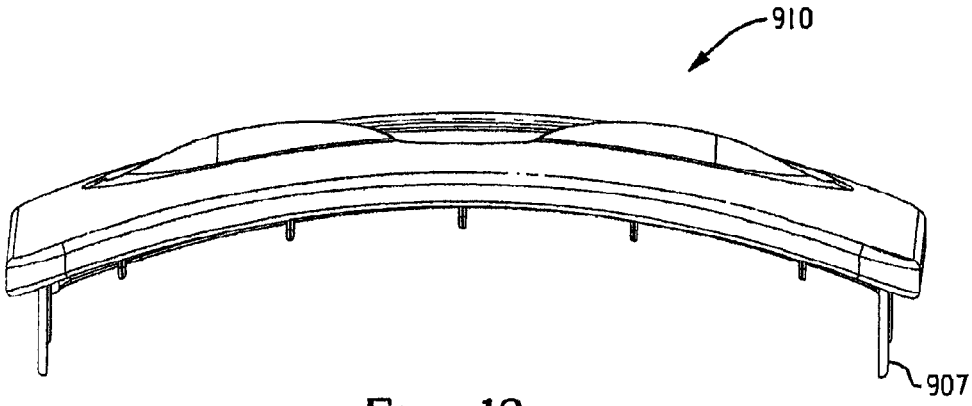
FIG. 12 illustrates a bottom view of the faceplate of FIG. 9.

FIG. 12 illustrates a bottom view of the faceplate 910.

Figure 13:
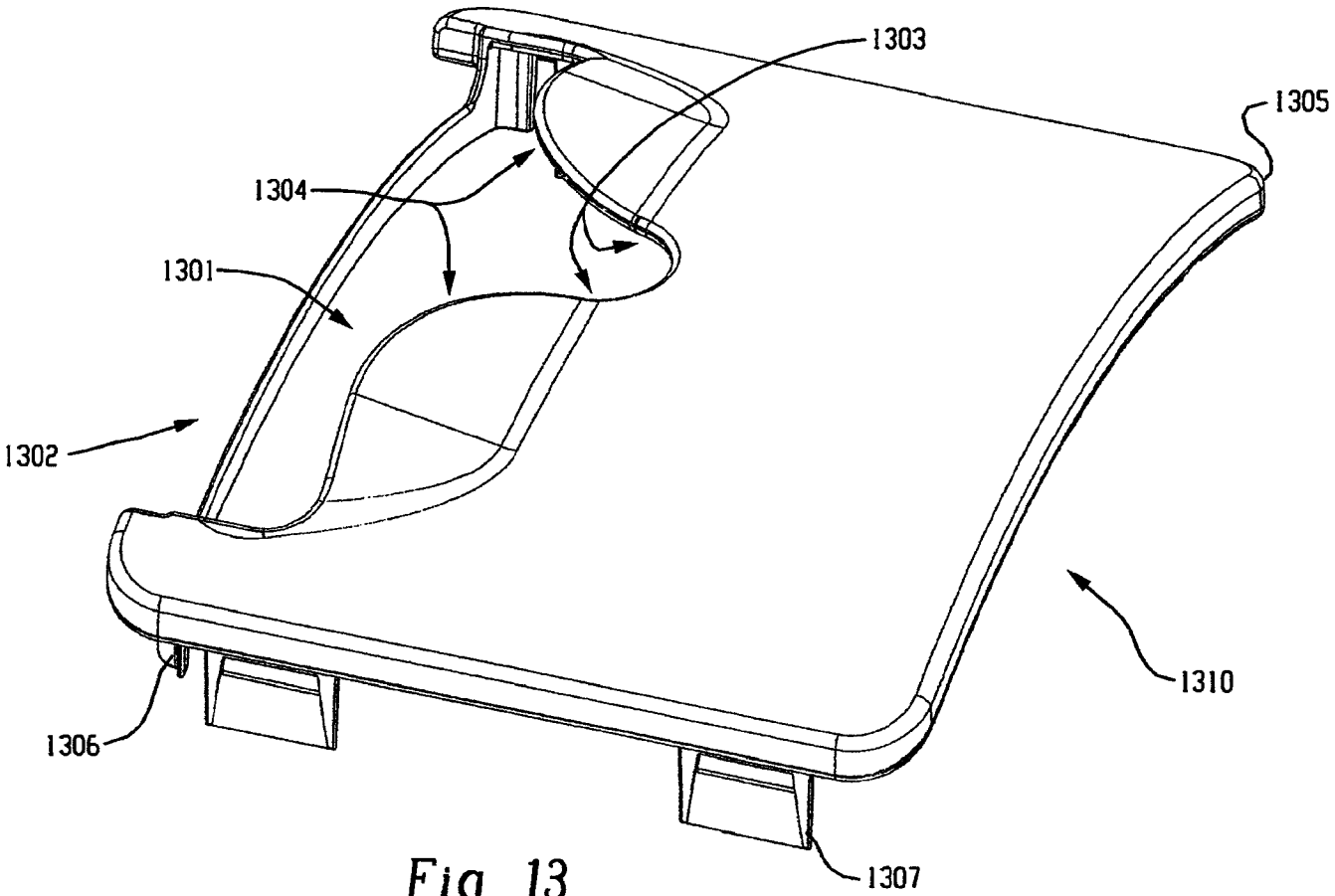
FIG. 13 illustrates a perspective view of another faceplate of a sheet product dispenser, according to an example embodiment.

FIG. 13 illustrates a perspective view of a faceplate of a sheet product dispenser 100, according to an example embodiment. As illustrated, the faceplate 1310 includes an opening 1301 defined by features 1302, 1303, and 1304 of body portion 1305. In an embodiment, feature 1302 is a substantially rectangular portion of the opening 1301 extending beyond an upper edge of an attachment portion 1306 the body portion 1305, defining an upper portion of the opening 1301, which enables a plurality of sheet products to be accessed simultaneously.

In an embodiment, feature 1304 is an arcing portion extending from a lower edge of the feature 1302 towards a lower and more confined arced apex of feature 1303. The combination of features 1303 and 1304 form an arcing triangular portion which exposes a planar surface of a single sheet product. As illustrated, the combination of features 1302, 1303, and 1304 allow dispensing of a selectable number of sheet products as the feature 1302 allows access to a plurality of sheet products, and the arcing portions 1304, and 1303 allow selection of any number of the accessible plurality of sheet products in a sequential fashion.

It is noted that due to the selectivity of the combination of features 1302, 1303, and 1304, a user may access a plurality of sheet products through the use of a single hand, thereby simplifying sheet product dispensing.

In an embodiment, the faceplate 1310 further includes attachment portions 1306-1307. The attachment portions 1306-1307 may be tabs, joints, slidable joints, snap-fit joints, or any other suitable attachment portion. As illustrated, attachment portion 1306 is below the feature 1302 such that sheet product is accessible easily through the feature 1302.

It is noted that the combination of features 1302, 1303, and 1304 may form a sheet product dispensing feature relatively smaller than the combination of features 502, 503, and 504 discussed above, and extending beyond the edge of attachment portion 1306. Therefore, the arcing triangular portion illustrated in FIG. 13 may be of relatively reduced height compared to the arcing triangular portion illustrated in FIG. 5.

Figure 14:
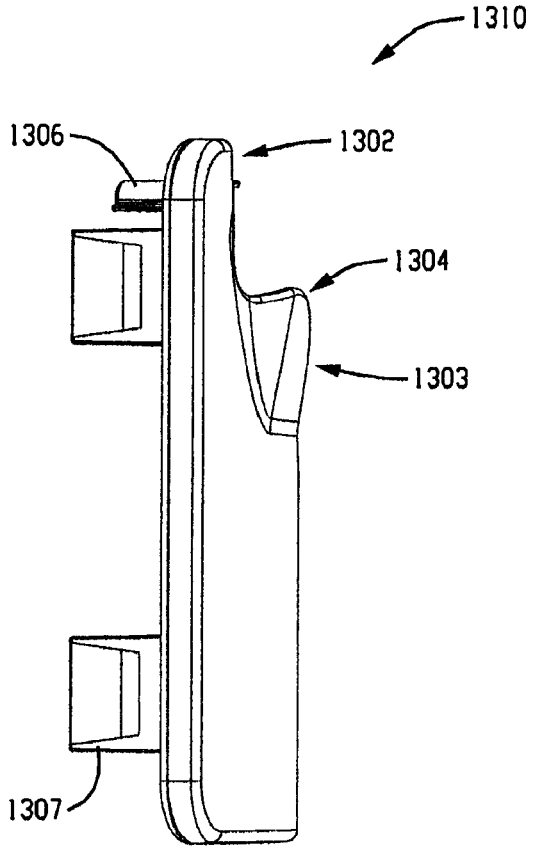
FIG. 14 illustrates a side view of the faceplate of FIG. 13.

FIG. 14 illustrates a side view of the faceplate 1310.

Figure 15:
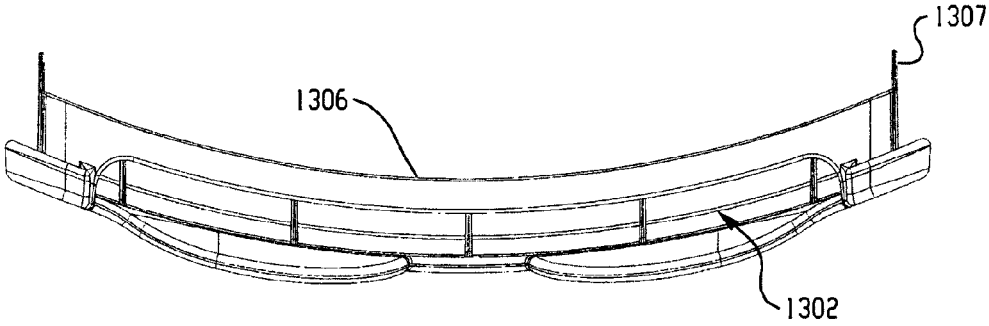
FIG. 15 illustrates a top view of the faceplate of FIG. 13.

FIG. 15 illustrates a top view of the faceplate 1310.

Figure 16:
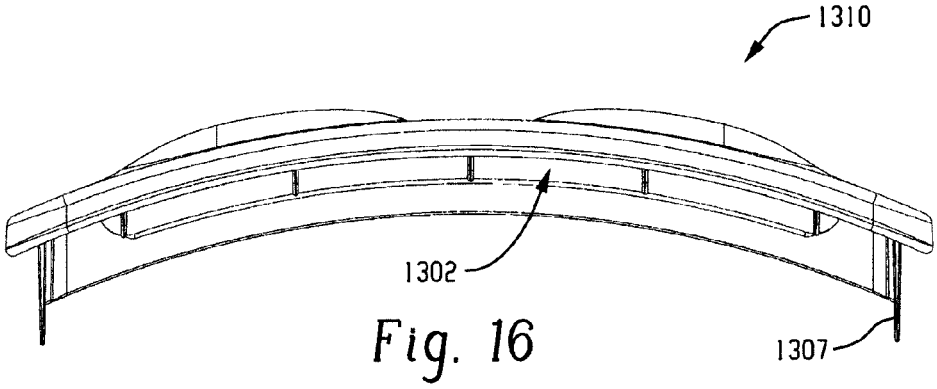
FIG. 16 illustrates a bottom view of the faceplate of FIG. 13.
Figure 18:
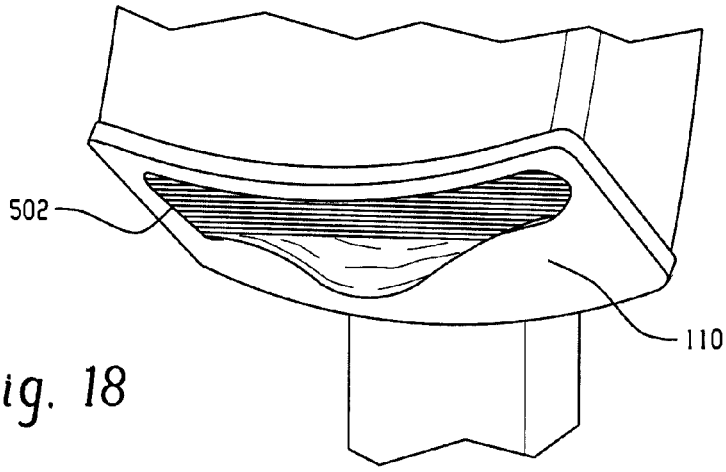
FIG. 18 illustrates a perspective view of the sheet product dispenser of FIG. 1.

FIG. 16 illustrates a bottom view of the faceplate 1310.

Figure 17:
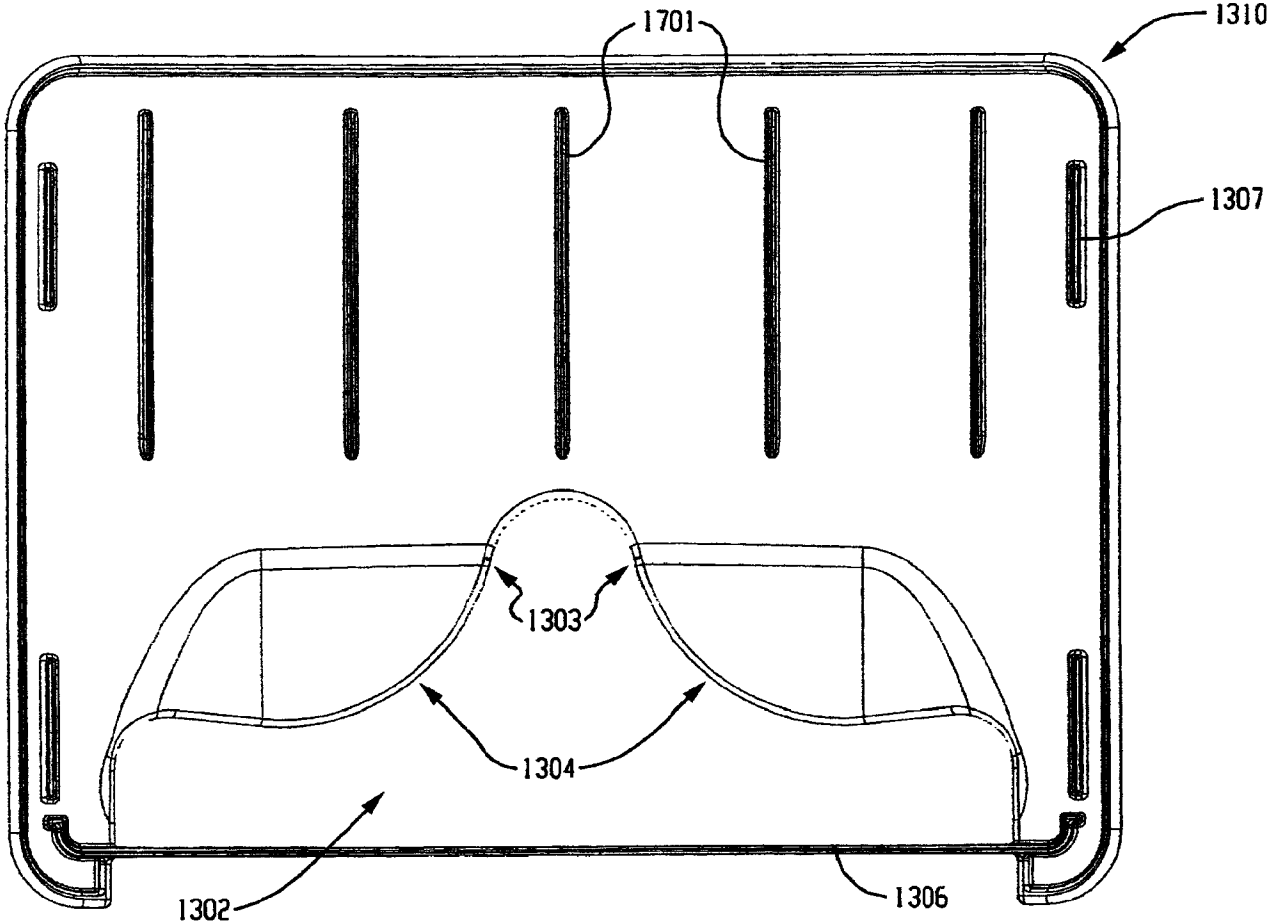
FIG. 17 illustrates a back view of the faceplate of FIG. 13.

FIG. 17 illustrates a back view of the faceplate 1310. As illustrated, the faceplate 1310 may include ribs 1701 to support sheet product.

While the invention has been described with reference to example embodiments, it will be understood that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed example embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A sheet product dispenser including:

a body portion defining an inner cavity arranged to support a stack of sheet products;

an outwardly curved faceplate attached to the body portion and arranged to support and dispense the sheet products, the faceplate having an opening comprising a rectangular portion with a centrally disposed arcing triangular portion having a centrally disposed arced apex, the rectangular portion extending from an upper edge of the faceplate to the arced apex, the opening extending outwardly from the faceplate, and the opening arranged to expose a plurality of the sheet products on one end of the body portion through the rectangular portion and to expose a planar surface of a single sheet product through the arcing triangular portion.

2. The dispenser of claim 1, further comprising: a stacked plurality of sheet products disposed and oriented within the inner cavity such that a planar surface of a single sheet product is disposed parallel to and exposed through the arcing triangular portion.

3. The dispenser of claim 1, wherein the body portion includes an attachment portion arranged to attach and support the faceplate.

4. The dispenser of claim 1, further comprising a pedestal extending from a rear wall of the body portion.

5. The dispenser of claim 1, wherein the triangular portion of the opening extends from the bottom edge of the protruding rectangular portion of the faceplate to an apex point beyond a height of the protruding rectangular portion.

6. The dispenser of claim 1, wherein the body portion includes a front wall joined to a first side wall and a second side wall, and a rear wall joined to the first side wall and the second side wall.

7. The dispenser of claim 6, wherein the front wall, first side wall, second side wall, rear wall, and faceplate define the inner cavity.

8. The dispenser of claim 6, wherein the first side wall and the second side wall are separated by a distance larger than the width of a sheet product.

9. The dispenser of claim 1, wherein the body portion includes a front wall joined to a first side wall.

10. The dispenser of claim 9, wherein the front wall is joined to the first side wall with a joint.

11. The dispenser of claim 10, wherein the joint is an integral connection, a slidable joint, or a snap-fit joint.

12. The dispenser of claim 1, wherein the faceplate is joined to a first side wall and a second side wall of the body portion.

13. The dispenser of claim 1, wherein the faceplate is joined to a first side wall of the body portion with a joint.

14. The dispenser of claim 13, wherein the joint is an integral connection, a slideable joint, or a snap-fit joint.

15. The dispenser of claim 1, wherein the body portion includes a rear wall and the rear wall includes a plurality of mounting holes arranged to support the body portion against a surface.

16. The dispenser of claim 1, wherein the body portion includes a top member joined to a first side wall of the body portion with a joint.

17. The dispenser of claim 16, wherein the joint is an integral connection, a slideable joint, or a snap-fit joint.

18. A sheet product dispenser, comprising:

a first side wall;

a rear wall joined to the first side wall;

a second side wall joined to the rear wall;

a front wall joined to the second side wall; and an outwardly curved faceplate attached to the body portion and arranged to support and dispense the sheet products, the faceplate having an opening comprising a rectangular portion with a centrally disposed arcing triangular portion having a centrally disposed arced apex extending outwardly from the faceplate, the rectangular portion extending beyond an upper edge of the faceplate to the arced apex, the opening arranged to expose a plurality of the sheet products on one end of the body portion through the rectangular portion and to expose a planar surface of a single sheet product through the arcing triangular portion.

19. An outwardly curved faceplate of a sheet product dispenser, comprising:

an opening, wherein:

the opening is arranged to expose a plurality of the sheet products on one end of the body portion through a rectangular portion of the opening and to expose a planar surface of a single sheet product through a triangular portion of the opening;

the rectangular portion of the opening arcingly protrudes from the faceplate; and the triangular portion of the opening extends from the bottom edge of the arcingly protruding rectangular portion of the faceplate to an apex point extending outwardly beyond a height of the arcingly protruding rectangular portion.

* * * * *